United States Patent [19]

Maezawa

[11] 4,209,973

[45] Jul. 1, 1980

[54] ELECTRONIC TIMEPIECE TIME ZONE DISPLAY

[75] Inventor: Shuzi Maezawa, Suwa, Japan

[73] Assignee: Kabushiki Kaisha Suwa Seikosha, Tokyo, Japan

[21] Appl. No.: 829,545

[22] Filed: Aug. 31, 1977

[30] Foreign Application Priority Data

Sep. 1, 1976 [JP] Japan ..... 51-104685

[51] Int. Cl.[2] ..... G04B 19/30

[52] U.S. Cl. ..... 368/84; 368/24; 368/232; 368/242

[58] Field of Search ..... 58/42.5, 43, 50 R, 23 R, 58/4 R, 4 A, 127 R

[56] References Cited

U.S. PATENT DOCUMENTS

| | | | |
|---|---|---|---|
| 811,585 | 2/1906 | Pheils | 58/43 |
| 927,472 | 7/1909 | Aufiero | 58/43 |
| 935,806 | 10/1909 | Olinger | 58/43 |
| 1,401,390 | 12/1921 | Caesar | 58/43 |
| 1,513,317 | 10/1924 | Frakes | 58/43 |
| 2,056,038 | 9/1936 | De Angelis et al. | 58/43 |
| 2,910,825 | 11/1959 | Kirkwood | 58/43 |
| 3,945,191 | 3/1976 | Van Berkum | 58/50 R X |
| 4,081,953 | 4/1978 | Crutcher | 58/50 R |

*Primary Examiner*—Ulysses Weldon

*Attorney, Agent, or Firm*—Blum, Kaplan, Friedman, Silberman & Beran

[57] ABSTRACT

A digital display for an electronic timepiece having first visual indication display segments peripherally disposed around numerical display digits for selectively indicating predetermined integral time zones corresponding to the time displayed by the numerical display digits and further visual indication display segments for discriminating time zones that are not integrally related to the time zones indicated by the first indication display segments is provided. The display is characterized by a bezel surrounding the plurality of visual indication display segments, the bezel having a plurality of first distinct indicia disposed therearound. Each of the first indicia are disposed proximate to the position of the first visual indication display segments to identify the predetermined global time zone selectively indicated thereby. At least one second indicia is disposed on the bezel intermediate a pair of first indicia. A second visual indication display segment is disposed proximate to each of the second indicia for discriminating between the integral global time zones, indicated by the first indication display segment, and the non-integrally related time zones indicated by the further indication display segments and second indicia disposed proximate thereto.

13 Claims, 1 Drawing Figure

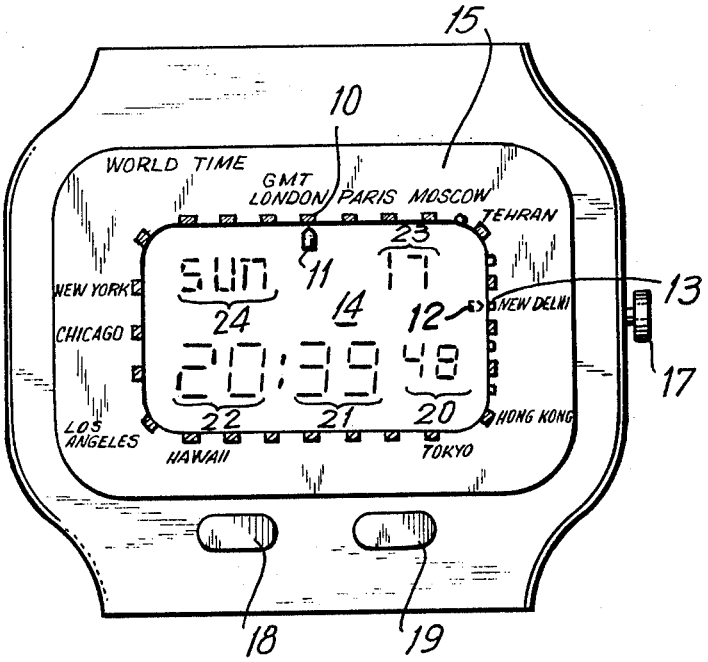
15
10
WORLD TIME
GMT
LONDON
PARIS
MOSCOW
TEHRAN
23
SUN
11
17
NEW YORK
24
14
12
NEW DELHI
13
CHICAGO
20:39
48
17
22
21
20
HONG KONG
LOS ANGELES
HAWAII
TOKYO
18
19

ELECTRONIC TIMEPIECE TIME ZONE DISPLAY

BACKGROUND OF THE INVENTION

This invention is directed to a digital display for an electronic timepiece having a plurality of visual indication display segments peripherally disposed around numerical display digits for indicating a predetermined global time zone corresponding to the time displayed by the numerical display digits, and in particular to further visual indication display segments and additional indicia corresponding thereto for discriminating between an integral global time zone, indicated by the first visual indication display segments, and a non-integrally related time zone indicated by the further indication display segments.

Heretofore, watches capable of providing an indication of the time for each of the twenty-four global time zones were, for the most part, mechanical or electromechanical hand display wristwatches. Such wristwatches were characterized by a bezel having a circular scale representative of each of the global time zones, with a location within each time zone being designated on the circular scale, in order to permit the wearer of the wristwatch to readily identify the particular time for that global time zone. The bezel, including the circular scale indicating the respective time zones by the localities therein, is manually rotated with respect to the hand display and provides a less than completely satisfactory global timepiece.

Although global digital display electronic timepieces have been developed wherein numerical digits are utilized to display time and a plurality of visual indication display segments are utilized to visually indicate the particular global time zones to which the numerical digits are indexed, such global timepieces have been limited to twenty-four time zones, each integrally related with respect to each other. Such a global timepiece is described in detail in U.S. Pat. application No. 768,461, which application is incorporated by reference herein. It is noted, however, that in addition to each of the twenty-four global time zones that are integrally related to a reference time, such as Greenwich Mean Time, there are additional time zones, such as the time zone in India, that are non-integrally related to Greenwich Mean Time. Specifically, the time difference between Greenwich Mean Time and the time zone in India is five and one-half hours. Nevertheless, global timepieces, having digital displays, have heretofore been unable to discriminate when the digital display is displaying time for a time zone that is non-integrally related to Greenwich Mean Time.

SUMMARY OF THE INVENTION

Generally speaking, in accordance with the instant invention, a digital display for an electronic timepiece having, in addition to a plurality of first visual indication display segments peripherally disposed about a numerical digital display for selectively indicating a predetermined integrally related global time zone, a further visual indication display segment for discriminating whether the time displayed by the numerical display digits is integrally related to the time zones indicated by the first visual indication display segments, is provided. The timepiece is particularly characterized by a bezel surrounding the plurality of first visual indication display segments, and is provided with a plurality of first distinct indicia disposed therearound, each of the first indicia being disposed proximate to the position of a visual indication display segment for identifying the predetermined integral time zones selectively indicated by the first visual indication display segments. At least one second indicia is disposed on the bezel intermediate a pair of the first indicia, and at least one second visual indication display segment is disposed proximate to the second indicia for discriminating between a predetermined integral global time zone, indicated by the first visual indication display segments, and a time zone that is not integrally related to the time zone indicated by the first visual indication display segment.

In an exemplary embodiment, the plurality of first visual indication display segments are utilized to visually indicate the twenty-four global time zones and are referenced to Greenwhich Mean Time, and the second indicia is positioned between a pair of first indicia in order to represent a time zone that is related to Greenwich Mean Time by an integer number of hours plus one-half an hour.

Accordingly, it is an object of the instant invention to provide an improved digital display electronic timepiece.

Still a further object of the instant invention is to provide an improved digital display electronic timepiece for displaying global time information.

Still another object of the instant invention is to provide an improved digital display electronic timepiece having first indicia for indicating an integrally related global time zone and second indicia for indicating time zones that are not integrally related to the time zones indicated by the first indicia.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawing, in which:

The drawing is a plan view of a global electronic timepiece, and in particular a digital display therefor, constructed in accordance with a preferred embodiment of the instant invention.

DETAILED DESCRIPTION OF THE PREFERRED EMBODIMENTS

Reference is now made to the drawing, wherein a liquid crystal digital display global electronic wristwatch, constructed in accordance with the instant invention, is depicted. For purposes of illustration, certain of the liquid crystal display segments, comprising the numerical digital display and visual identification display segments, explained in detail below, are depicted as being energized in the drawing.

The global digital display is comprised of seconds digits 20, minutes digits 21, hours digits 22, date digits 23 and a day of the week display 24. With the exception of the tens of date digits, and the tens of hours digits, the remaining numerical digits, for displaying seconds, minutes and hours, conform to a conventional seven-bar numerical display liquid crystal arrangement. Since the tens of date digit does not exceed three (3) a conventional seven-bar numerical configuration is not required. Additionally, the colon (:), between the minutes digits 21 and hours digits 12, can be formed from liquid crystal display segment electrodes or, alternatively, can be permanently formed on the face of the digital display.

In order to effect a global display, twenty-four (24) first integrally related visual indication display segments 10 are peripherally disposed around the numerical digital display, generally indicated as 14, each of the respective visual display segments being representative of one of the twenty-four integral time zones. As utilized herein, the term "integral time zone" refers to a time zone that is distinct from Greenwich Mean Time by a number of hours equal to an integer from one (1) to twenty-three (23). For example, there is a one hour difference between the time in Paris and the time in London, London being in the same time zone as Greenwich Mean Time. To this end, a bezel 15 surrounds the digital display 14 and has disposed therearound first indicia indicating the particular locality, or other designation, for identifying the particular time zone to which the first visual indication display segments 11 refer. As is explained in greater detail in U.S. Pat. application No. 768,461, which application is incorporated by reference, as if fully set forth herein, the global display wristwatch energizes one of the time zone visual indication display segments 11 to illustrate the time zone corresponding to the time displayed by the numerical digits of the digital display. In order to obtain the time at a different time zone, the operator of the timepiece need only displace crown 17 to a time zone select position and thereafter actuate push button 18 or push button 19 on the face of the wristwatch. In response to actuating the push button 18, the time zone will be indexed in a clockwise direction, one time zone for each pushing of a push button 18, whereas each pushing of push button 19 will result in an indexing by one of each of the time zones in a counter-clockwise direction. Moreover, when the crown 17 is in other than a time zone selecting position, the push buttons 18 and 19 can be utilized as time correction switches.

As is diagrammatically illustrated in FIG. 1, the first cross-sectioned indicia, formed on the bezel, represents global time zones that are integrally related to Greenwich Mean Time and are indicative of either a specific geographical location in the time zone, or other information identifying the time zone. As aforenoted, the London time zone is also represented by the designation GMT, which designation stands for Greenwich Mean Time. Because Greenwich Mean Time is a reference that is compared with other time zones, the indicia representative of Greenwich Mean Time is disposed at the twelve o'clock position of the wristwatch (when reference is made to a conventional analog clock face) in order to permit the wearer to readily compare the time difference between the time displayed for a particular time zone with the Greenwich Mean Time zone. For the example, as illustrated in the drawing, the digital display 14 indicates that on the seventeenth (17th) day of the month in London, which is a Sunday, the time is forty-eight (48) seconds and thirty-nine (39) minutes into the twentieth (20th) hour.

It is noted however that there are several global time zones that are not integrally related to Greenwich Mean Time. For example, there are several time zones in Southeast Asia that, instead of being integrally related to Greenwich Mean Time, are related thereto by a time interval equal to a predetermined integral number of hours, plus thirty (30) minutes. In order to permit the wearer of the wristwatch to discriminate between the global time zones that are integrally related to Greenwich Mean Time and those which are related thereto by an integral number of hours plus thirty (30) minutes, a second plurality of indicia 13 have been provided between pairs of integrally related first indicia 10. Additionally, a plurality of second visual indication display segments 12, that are of different size or color than the first visual indication display segments, are disposed proximate to the second indicia for permitting the wearer to clearly discriminate between time zones that are non-integrally related to Greenwich Mean Time and are indicated by the second indicia and those time zones that are integrally related to Greenwich Mean Time.

For example, the time difference between India (New Delhi) and Greenwich Mean Time is five and one-half hours. Accordingly, the second indicia, indicated in the drawing by the marks that are free of cross-sectioning, are disposed on the bezel and are also either of a different size or of a different color than the first indicia peripherally disposed around the bezel that are representative of a time difference that is integrally related to Greenwich Mean Time. Thus, both the second visual indication display segments and the second indicia are readily discriminated from the first visual indication display segments and first indicia by being formed of different sizes and colors.

By the arrangement detailed above, the wearer of the wristwatch not only is able to readily identify the time in each of the global time zones of the world, but also whether the global time zones are related by an integral number of hours to Greenwich Mean Time, or by a number of hours plus thirty (30) minutes with respect to Greenwich Mean Time. Moreover, by providing a global timepiece that can discriminate between global time zones that are integrally related to Greenwich Mean Time and those global time zones that are non-integrally related to Greenwich Mean Time, the information obtained from the timepiece corresponds to the time zone information that would be gleaned from a map or other geographical instrument.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a digital display for an electronic timepiece including a plurality of numerical display digits for displaying time information and a plurality of first visual indication display segments peripherally disposed about said numerical display digits, at least one of said first visual indication display segments being adapted to be selectively rendered visually distinguishable from the remaining plurality of first visual indication display segments for selectively indicating a predetermined integral time zone corresponding to the time displayed by said numerical display digits, a bezel surrounding said plurality of first visual indication display segments and having a plurality of first distinct indication means disposed therearound, each said first indication means being disposed proximate to the position of a first visual indication display segment for identifying the predetermined integral time zones selectively indicated by the first visual indication display segments being rendered visually distinguishable, the improvement comprising at least one second indication means disposed on said bezel, each said second indication means being positioned intermediate a pair of said first indication means, and at least one second visual indication display segment disposed proximate to said second indication means for being selectively rendered visually distinguishable with respect to each of said first visual indication display segments for discriminating between a predetermined integral time zone indicated by said at least one of said first visual indication display segments that is rendered visually distinguishable from the remaining plurality of first visual indication display segments and a further time zone indicated by the second visual indication display segments being rendered visually distinguishable and second indication means that is non-integrally related to the time zones indicated by the first visual indication display segments.

2. A digital display as claimed in claim 1, wherein said first visual indication display segments and said first indication means are peripherally disposed around said numerical display digits, and at least one of the first visual indication display segments and first indication means adjacent thereto are representative of a reference global time zone, said remaining first visual indication display segments being integrally related to said reference time zone.

3. A digital display as claimed in claim 2, wherein said reference time zone is disposed about said numerical digits at a twelve o'clock position.

4. A digital display as claimed in claim 2, wherein said reference time is Greenwich Mean Time.

5. A digital display as claimed in claim 3, wherein said Greenwich Mean Time indication means is disposed about said numerical digits at a twelve o'clock position.

6. A digital display as claimed in claim 1, wherein each of said first visual indication display segments are peripherally disposed around said numerical digital display and are disposed at substantially equal distances with respect to each other, said second indication means being disposed substantially midway between each pair of first indication means adjacent thereto, whereby said second indication means are representative of the non-integral relationship between the global time zones represented thereby and the global time zones represented by said first indication means.

7. A digital display as claimed in claim 1, wherein said second visual indication display segments are distinct in appearance from said first visual indication display segments.

8. A digital display as claimed in claim 7, wherein each second visual indication display segment is a different color from said first visual indication display segments.

9. A digital display as claimed in claim 7, wherein each second visual indication display segment is a different size than said first visual indication display segments.

10. A digital display as claimed in claim 1, wherein said second indication means are distinct from said first visual indication means.

11. A digital display as claimed in claim 10, wherein said second visual indication means are a different color than said first visual indication means.

12. A digital display as claimed in claim 10, wherein said second visual indication means are a different size from said first visual indication means.

13. A digital display as claimed in claim 1 wherein each of said display digits and said visual indication display segments are liquid crystal display cells.

* * * * *